United States Patent [19]

Fiedler

[11] Patent Number: 4,571,956

[45] Date of Patent: Feb. 25, 1986

[54] WARP KNITTING MACHINE WITH WEFT THREAD MAGAZINE

[75] Inventor: Hans Fiedler, Obertshausen, Fed. Rep. of Germany

[73] Assignee: Karl Mayer Textilmaschinenfabrik GmbH, Fed. Rep. of Germany

[21] Appl. No.: 752,293

[22] Filed: Jul. 3, 1985

[30] Foreign Application Priority Data

Jul. 7, 1984 [DE] Fed. Rep. of Germany ..... 3425085

[51] Int. Cl.[4] ..... D04B 23/06

[52] U.S. Cl. ..... 66/84 A; 66/214

[58] Field of Search ..... 66/207, 214, 85 A, 84 A

[56] References Cited

U.S. PATENT DOCUMENTS 3,911,699 10/1975 Kamp ..... 66/214
4,137,734 2/1979 Kohl ..... 66/214
4,437,323 3/1984 Hittel et al. ..... 66/84 A
4,442,684 4/1984 Bergmann et al. ..... 66/84 A
4,449,380 5/1984 Wilkens ..... 66/84 A X

*Primary Examiner*—Ronald Feldbaum
*Attorney, Agent, or Firm*—Omri M. Behr

[57] ABSTRACT

There is provided a warp knitting machine having needles and warp thread guides. A weft thread magazine has forwarding chains for providing the weft thread. Weft thread insertors bring the weft thread to the outtake side of the needles. At the upper dead point of the needles the weft threads are located in an inlay space between the outtake side of the needles and the innermost warp thread extending from the thread guides. Several of the innermost thread guides are provided with a rearwardly directed protrusion which, during the forwardly directed through-swing of the thread guides substantially closes off the inlay space at the upper dead point of the needles. This system reduces substantially the number of weft thread errors.

9 Claims, 4 Drawing Figures

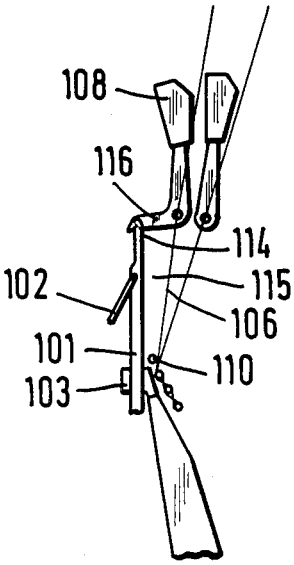
Fig.3
Fig.4
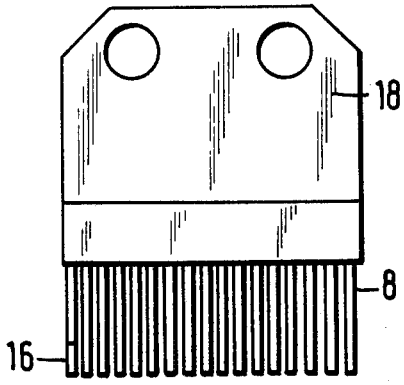

WARP KNITTING MACHINE WITH WEFT THREAD MAGAZINE

BACKGROUND OF THE INVENTION

The present invention is related to a weft thread machine with needles, warp thread guides, and a weft thread magazine.

Magazines of this type can be provided with a pair of chains for forwarding the weft thread which, in the vicinity of the guides, moves with a vector having a substantial horizontal component. The machine further comprises weft thread insertors which, when the needles move downwardly, move the weft threads from the hook side to the outtake side so that at the upper dead point of the needles, the threads are located in a substantially enclosed space between the outtake side of the needle and the innermost of the warp thread guides.

A warp knitting machine of this type is known in the art (see for example U.S. Pat. No. 4,442,684). In this machine the weft threads are supplied by the forwarding chains at an angle of about 30° to the horizontal, are timely separated by the weft thread insertors and brought to the outtake side of the needles where they are tied in by the next stitch building step.

Where extremely thick weft thread material is used and/or where the stroke of the needle is short, it has been found that weft thread errors occur. In particular errors result from the so called "rearward lay" in which the weft threads are captured by the needle head and tear or can even break off the hook of the needle.

It is further known (DE-OS No. 2,319,348) to provide a machine in which the weft threads are forwarded in the grooves of two forwarding wheels which provide them with a substantially vertical travel path in the vicinity of the needles and permits them to be dropped substantially perpendicularly into the weft thread insertors. Since the weft threads hang between the forwarding tooth wheels and can thus interfere with the free movement of the weft thread insertors, certain warp thread guides of the rearmost guide bar are provided with a pair of protrusions located above each other. The lower protrusion holds the next weft thread to be supplied for such a time outside the grasp of the weft thread insertors till these have reached their weft thread capture position. Then the weft thread is released through the forward swinging of the guide bar and taken up by the weft thread insertor. The second protrusion insures an unequivocal separation of the sequentially following weft threads.

It is the purpose of the present invention to provide a warp knitting machine of the foregoing type wherein the danger of weft thread errors is substantially reduced.

SUMMARY OF THE INVENTION

A warp knitting machine for producing knitted ware from warp and weft threads, according to the principles of the present invention comprises a plurality of needles. Each of the needles has an outtake side and each is mounted to reciprocate between an upper and lower dead point. Included are a plurality of warp thread guides mounted to swing with respect to the needles. A predetermined number of the guides are positioned innermost. The machine also includes a weft thread magazine for forwarding the weft threads toward the needles with a substantial horizontal vector component near the warp thread guides. The weft thread magazine further comprises weft thread insertors for bringing the weft threads across the needles to their outtake side, when the needles are moving downwardly. The insertors are operable to place the weft threads in any inlay space. This inlay space is bounded, when the needles are at the upper dead point, by the outtake side of the needles and those warp threads running from the innermost ones of said thread guides. The innermost ones of the thread guides have an inwardly directed protrusion which, during the backward swing of the thread guides during the upper dead point of the needles, substantially closes off the inlay space.

By employing apparatus of the foregoing type, the danger of weft thread errors is substantially reduced. This problem is solved thereby in that certain of the innermost weft thread guides are provided with inwardly directed protrusions which, during the forward swing of the guide bars at the upper dead point of the needles, substantially close off the aforesaid inlay space. The reasoning behind this construction is as follows: The weft thread insertors must move rearwardly when the guide bars are swung from the front to the rear, since otherwise the insertion of the warp threads into the spaces between the needles would be hindered. During the rearward movement of the weft thread insertors, the weft threads are left for a short space of time without any substantial means of control or support. The only support is provided by the forwarding chains. During the upward travel of the needles, the weft thread can be forced upwardly by the needle shaft and thus pressed backwardly by the tensioned, rearwardly swinging warp threads and thus moved out of the inlay space. If there are, however, employed the protrusions forseen by the present invention, there is no possibility for the weft threads to stray out of the inlay space. It thus follows that the weft threads can not be grasped by the needle heads and torn. Neither can the needle hooks be broken by them.

In order to avoid the aforesaid problem, it is sufficient that the protrusions be provided with such a length that during the forwardly directed swinging movement of the guide bar at the upper dead point of the needles, this protrusion reaches close to the outtake side of the hook. The crux of the invention is that the space which remains between the protrusion and the needle is so small that there is no possibility for the weft thread to escape from it. The safety provided by the present invention as described above, can be further enhanced if the length of the protrusion is increased so that during the aforesaid forwardly directed swinging movement of the guide bars at the upper dead point of the needles, it protrudes into the space between the needles. Such a construction also takes into account the fact that it is desirable to set the aforesaid swinging movement of the guide bars with reference to the position of the needles.

A further improvement may be achieved where the lower edge of said protrusion is provided to be at substantially the same level as the lower edge of the innermost warp thread guide. Such an arrangement takes cognizance of the fact that the upper dead point of the needles is a substantially fixed point, but the height of the warp thread guides is adjustable. For example, thread guides may be moved from a setting in which the upper edge of the hole therein is substantially level with the upper edge of the inner portion of the hook; right up to a higher setting in which the lower edge of said hole is substantially level with the upper edge of the inside of the hook. It has been found that even in the latter setting a safer closure of the inlay space is provided.

It has further been found that it is sufficient if merely one of the warp thread guides in each set of thread guides (which are conventionally soldered together) carry one protrusion. Thus, depending upon the separation of the needles, there will usually be one protrusion for about every 5 to 20 thread guides.

BRIEF DESCRIPTION OF THE DRAWING

The above brief description as well as other features and advantages of the present invention will be more fully appreciated by reference to the following detailed description of a presently preferred but nonetheless illustrative embodiment in accordance with the present invention when taken in conjunction with the accompanying drawings, wherein:

FIG. 3 is a side, elevational view of the immediate needle/warp thread guide environment, illustrating the "closed" mode of the invention; and FIG. 4 is a plan view of a set of warp thread guides, one of which carries the protrusion of the invention. cl

DETAILED DESCRIPTION OF THE INVENTION

Figure 1:
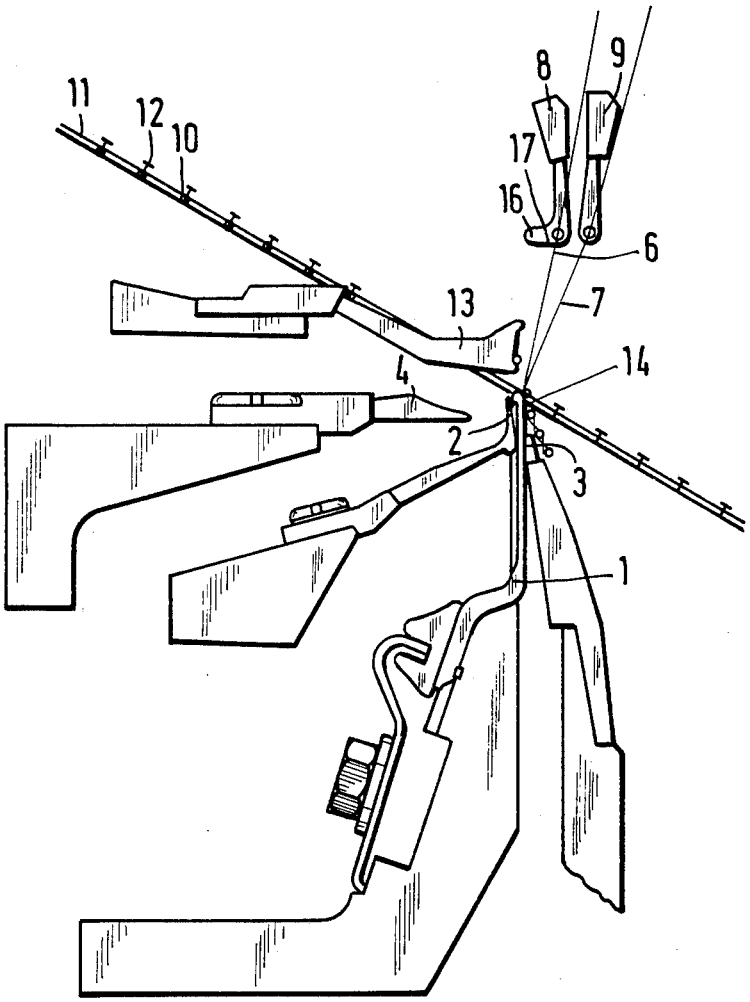
FIG. 1 is a schematic, side elevational view of the work area of a knitting machine showing the weft thread insertors in the forward position.
Figure 2:
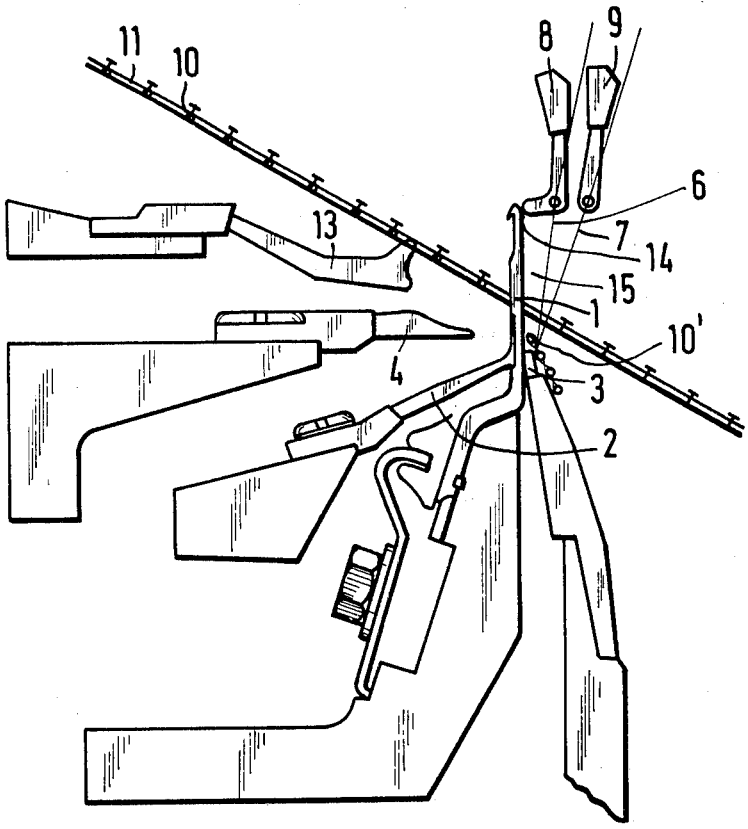
FIG. 2 is a view similar to FIG. 1 but wherein the weft thread insertors are withdrawn.

In the embodiment of the invention illustrated in FIGS. 1 and 2, the needles 1 are provided with sliders 2. In the conventional manner, there is provided a knock-over sinker 3 and a stitch comb 4. Thread guides 8 and 9 are used to provide warp threads 6 and 7. Guides 8 and 9 are mounted to swing with respect to needles 1 (left and right in the views of FIGS. 1–3).

Weft threads 10 are laid across a pair of endless chains 11 that are arranged as shown, for example, in U.S. Pat. No. 4,442,684. The weft threads 10 are forwarded toward the work area by means of the two forwarding chains 11. Chains 11 each have a row of holding elements 12 for holding weft thread 10 and operating at an angle of approximately 30° to the horizontal, that is to say, comprising a very substantial, horizontally directed vector. In the vicinity of needles 1 the weft threads 10 are taken over by the weft thread insertors 13 and moved from the hook side of the needle to the outtake side 14. Insertors 13 reciprocate in and out of the work area following a path as disclosed in U.S. Pat. No. 4,442,684. During the upward travel of the needles 1 to their upper dead point, the last inlaid weft thread 10' is located in the inlay space 15, between the outtake side 14 of the needle 1 and the innermost warp thread 6.

The arrangement described to this point is conventional. In the present invention, however, several of the thread guides 8 are shaped with an inwardly directed length terminating in a transverse protrusion 16. The lower edge of protrusion 16 is at the same level as the lowest edge of the innermost thread guide 8. The length of protrusion 16 is set so that when the guide bar is swung forwardly to its greatest extent, at the upper dead point of needle 1, the inlay space 15 is entirely closed (see FIG. 2). Under these circumstances the weft thread 10', which possibly could have been pressed upwardly by the upward movement of needle 1 cannot, during the backward swing of the guide bar, be pressed out from this space.

In the arrangement illustrated in FIG. 3, the reference numbers for similar components were increased by 100. The arrangement of FIG. 3 can be differentiated from that of FIGS. 1 and 2 in that the needles 1 have tongues 102. Also, the protrusion 116 of warp thread guide 108 has such a length that it protrudes between the hooks, that is to say, into the space between the needles.

It will also be seen that the warp thread guide 108 has a greater height relative to the hooks of needle 101 (as compared to the apparatus of FIG. 2), but nevertheless, the insertion space is entirely closed.

In FIG. 4 the guide set 18 includes a rectangular metal plate having a pair of mounting holes adjacent two angled corners. On the edge opposite the mounting holes there is provided a plurality of guides 8 for which only one has protrusion 16. These sets 18 are, in the usual fashion, mounted on a guide bar to provide a multiplicity of parallel weft thread guides. In another embodiment of the invention, in place of utilizing weft thread guides, insertion tubes can also be utilized.

To facilitate an understanding of the principles associated with the foregoing apparatus of FIGS. 1–2 and 4, its operation will be briefly described. It will be appreciated that although somewhat different, the structure of FIG. 3 operates in substantially the same fashion. For each stitch cycle, needles 1 reciprocate vertically, slider 2 closing the needle hook at the appropriate interval during each cycle. Simultaneously thread guides 8 and 9 swing between the forward and rearward sides of needles 1 and shog relative thereto to execute the well-known overlapping and underlapping operations. When a new stitch is formed on the needles 1, knock-over sinker 3 completes the operation by "knocking-over" the newly formed loops.

During the stitching cycle, weft threads 10, are placed upon chains 11 at an upstream position and delivered to the working area by chains 11. As shown in FIG. 1, insertor 13 lifts a single weft thread off chains 11 and carries it over needles 1 to the far or outtake side of needles 1 and then retracts. At this time needles 1 rise to the position shown in FIG. 2. The length of protrusion 16 is set, however, so that when the guide bar is swung forwardly to its greatest extent, at the upper dead point at needle 1, the inlay space 15 is entirely closed (see FIG. 2). Accordingly, thread 10' is trapped in inlay space 15 between thread 6, needles 1 and protrusion 16. Importantly, as guides 8 and 9 swing backwardly, protrusion 16 prevents weft thread 10' from riding over needles 1 and tearing or otherwise interfering with the stitching of needles 1.

The principles of the present invention can be utilized for all needles one might choose, in particular, those which have a short travel path. Thus, they are suitable not only for slider needles and latch needles, but also, for example, for lace needles. The invention may be utilized on all types of warp knitting machines, including, but not limited to, automatic warp knitting machines or Russell machines. The angle subtended by the forwarding chains can also be horizontal, but in practice there is utilized an angle to the horizontal not exceeding 45°.

Obviously, many modifications and variations of the present invention are possible in light of the above teachings. It is, therefore, to be understood that within the scope of the appended claims, the invention may be practiced otherwise than as specifically described.

What is claimed is:

1. A warp knitting machine for producing knitted ware from warp and weft threads, comprising:

a plurality of needles each having an outtake side and each mounted to reciprocate between an upper and lower dead point;

a plurality of warp thread guides mounted to swing with respect to said needles, a predetermined number of said guides being positioned innermost;

a weft thread magazine for forwarding said weft threads toward said needles with a substantial horizontal vector component near said warp thread guides, said weft thread magazine further comprising:

weft thread insertors for bringing said weft threads across said needles to their outtake side when said needles are moving downwardly, said insertors being operable to place said weft threads in an inlay space bounded, when said needles are at said upper dead point, by said outtake side of said needles and those warp threads running from said innermost ones of said thread guides, said innermost ones of said thread guides having an inwardly directed protrusion which, during the backward swing of said thread guides during said upper dead point of said needles, substantially closes off said inlay space.

2. A warp knitting machine in accordance with claim 1 wherein said protrusion is sized to reach substantially to the outtake side of said needles during the rearwardly directed through-swing of the guide bars at the upper dead point of the needles.

3. A warp knitting machine in accordance with claim 1 wherein said protrusion is sized to reach, during the rearwardly directed through-swing of the guide bars at the upper dead point of the needles, into the space between said needles.

4. A warp knitting machine in accordance with claim 1 wherein the lower surface of said protrusion is oriented at about the same height as the lower edge of the innermost warp thread guide.

5. A warp knitting machine in accordance with claim 1 wherein said plurality of warp thread guides comprise:

a plurality of thread guide segments, each having at least a predetermined number of segment guides, said protrusion comprising:

a plurality of protrusions each corresponding to a respective one of said thread guide segments, at least one of said segment guides in each of said warp thread guide segments being provided with corresponding one of said protrusions.

6. A warp knitting machine in accordance with claim 2 wherein said plurality of warp thread guides comprise:

a plurality of thread guide segments, each having at least a predetermined number of segment guides, said protrusion comprising:

a plurality of protrusions each corresponding to a respective one of said thread guide segments, at least one of said segment guides in each of said warp thread guide segments being provided with a corresponding one of said protrusions.

7. A warp knitting machine in accordance with claim 3 wherein said plurality of warp thread guides comprise:

a plurality of thread guide segments, each having at least a predetermined number of segment guides, said protrusion comprising:

a plurality of protrusions each corresponding to a respective one of said thread guide segments, at least one of said segment guides in each of said warp thread guide segments being provided with a corresponding one of said protrusions.

8. A warp knitting machine in accordance with claim 4 wherein said plurality of warp thread guides comprise:

a plurality of thread guide segments, each having at least a predetermined number of segment guides, said protrusion comprising:

a plurality of protrusions each corresponding to a respective one of said thread guide segments, at least one of said segment guides in each of said warp thread guide segments being provided with a corresponding one of said protrusions.

9. A warp knitting machine in accordance with claim 1 wherein said weft thread magazine comprises:

a pair of parallel, spaced chains.

* * * * *